United States Patent [19]

Spindler

[11] 4,177,847

[45] Dec. 11, 1979

[54] SLIP-ON GUITAR COVER

[76] Inventor: Stanley G. Spindler, 1926 Farmbrook, Troy, Mich. 48098

[21] Appl. No.: 9,609

[22] Filed: Feb. 5, 1979

[51] Int. Cl.[2] ..... G10G 7/00

[52] U.S. Cl. ..... 150/52 R; 84/453

[58] Field of Search ..... 150/52 R; 84/453

[56] References Cited

U.S. PATENT DOCUMENTS

| | | | |
|---|---|---|---|
| 3,877,501 | 4/1975 | Toth | 150/52 R |
| 4,000,678 | 1/1977 | Messina | 84/453 |

*Primary Examiner*—Donald F. Norton

*Attorney, Agent, or Firm*—Harness, Dickey & Pierce

[57] ABSTRACT

A protective, slip-on cover made of soft, absorbant material and adapted to protect the sound box of an electric guitar. The cover is preferably made of a natural, soft fiber such as cotton and has front, side and back sheets which are sewn together to correspond generally to the shape of the sound box. The front cover has a recessed portion and a plurality of slots to allow installation and removal of the cover with respect to a guitar.

7 Claims, 5 Drawing Figures

FIG. 1.
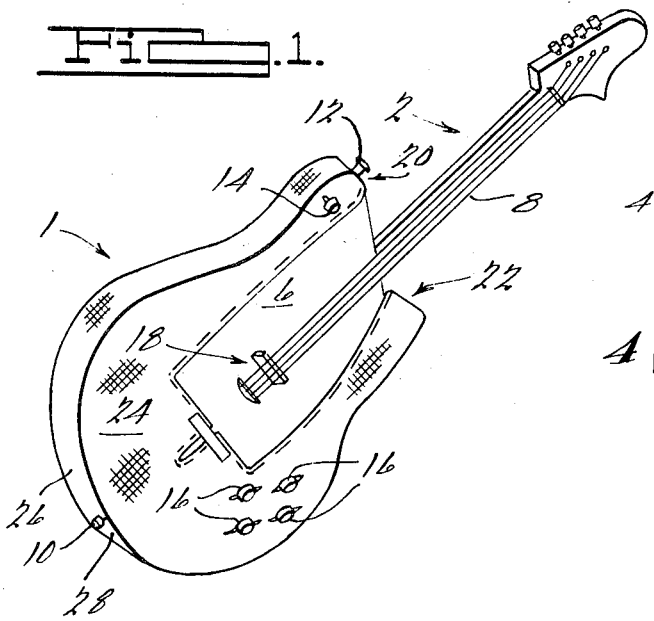
FIG. 2.
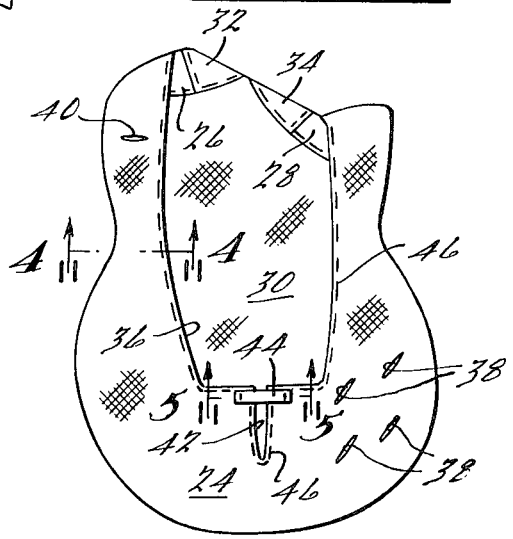
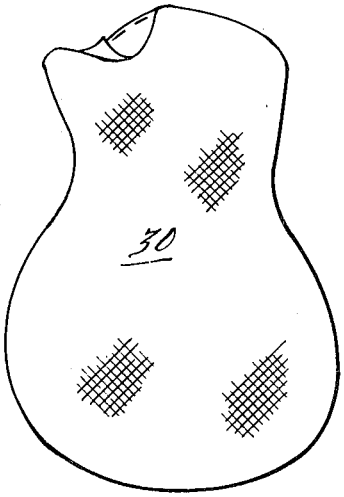
FIG. 3.
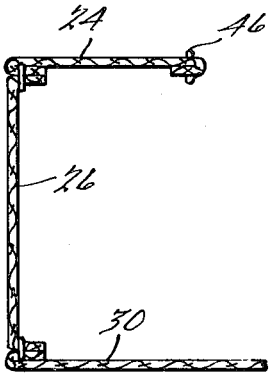
FIG. 4.
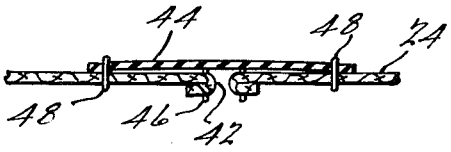
FIG. 5.

SLIP-ON GUITAR COVER

BACKGROUND OF THE INVENTION

The present invention relates to a novel, slip-on guitar cover designed to protect the finish of a guitar against scratches or the wear and marring occurring during normal usage.

It is well known that the finish provided on the sound box of a guitar is subject to marring, scratching and general wear during the playing thereof due to moisture and friction from the player's hand, friction against belt buckles and the like. Protective jackets for string instruments are shown in several patents including U.S. Pat. Nos. 3,877,501, Apr. 15, 1975, to Toth; 4,000,678, Jan. 4, 1977, to Messina; 3,251,258, May 17, 1966, to Parker; and 3,309,954, Mar. 21, 1967, to Phillips, et al.

It is an object of the present invention to provide a novel and improved guitar cover. More specifically, it is an object of the present invention to provide a guitar cover made of soft, washable, natural fiber material adapted to slip on and off the sound box of an electric guitar having a plurality of control knobs. Yet another object of the present invention is to provide a guitar cover which is capable of absorbing moisture such as that associated with a musician's hand and yet which effectively protects the sound box from scratching or marring. Still another object is to provide a guitar cover which is easily slipped onto the sound box and yet is securely attached thereto. These and other features, objects, and advantages of the present invention will be apparent from the following description and appended claims taken in conjunction with the accompanying drawings.

BRIEF DESCRIPTION OF THE DRAWING

FIG. 1 is a perspective view of a guitar cover of the present invention slipped onto a conventional electric guitar;

FIG. 2 is a front elevational view of a guitar cover of the present invention, with the top portion thereof in perspective;

FIG. 3 is a rear elevational view of the guitar cover of the present invention;

FIG. 4 is a sectional view taken along line 4—4 of FIG. 2; and

FIG. 5 is a sectional view taken along line 5—5 in FIG. 2.

DESCRIPTION OF THE INVENTION

The present invention relates to a protective guitar cover especially adapted to protect the sound box of a guitar from moisture and friction due to a musician's hand and from scratching or other marring which might be effected by a belt buckle or the like. It will be appreciated that the guitar cover of the present invention is intended to serve its protective function primarily during times of use of the instrument. It will also be appreciated from the following disclosure that the present invention is well calculated to protect the sound box portion of the guitar while also offering a cover which is easily slipped onto a guitar and yet which remains securely attached once slipped thereon. Also, the cover of this invention is economically constructed and made of washable material so as to allow easy cleaning or washing thereof. In addition, the guitar cover of the present invention is designed so as to facilitate attachment to and removal from a guitar sound box.

Now referring to the figures, FIG. 1 shows a guitar cover of the present invention, indicated generally by the numeral 1, in operative position on a conventional electric guitar 2. Electric guitar 2 has a sound box 6 with a neck 8 extending therefrom, and has means for attaching a carrying strap thereto shown at 10 and 12. Extending from the front of sound box 6 is a control knob 14 and a plurality of control knobs 16. Sound box 6 also has a bridge portion for mounting the bridge which is proximate to the portion of the strings which are picked or otherwise manipulated to generate musical tones.

As shown in FIGS. 1–5, guitar cover 1 generally comprises a front sheet 24, side sheets 26 and 28, and bottom sheet 30 which are sewn to each other at respective adjacent edge portions. It will be appreciated by those skilled in the art that side sheets 26 and 28 can be integrally formed or can comprise two sheets sewn together proximate to carrying strap attachment means 10 as shown in FIG. 1. A slit is provided at the juncture of side sheets 26 and 28 through which extends carrying strap attachment means 10.

The exact shape of front, side and back sheets 24, 26, 28, and 30 is, of course, dependent upon the shape of the sound box of the particular guitar to which guitar cover 1 is to be attached. Front and back sheets 24 and 30 have outer perimeter edges corresponding to the outer shape of sound box 6 and might have, for example, a maximum width of about 13 inches and a maximum length of about 17½ inches. Side sheets 26 and 28 conform to the side portion of the guitar and might have a width of about two inches and a length great enough to extend around sound box 6 and form shoulder portions 20 and 22 which fittingly receive corresponding shoulders of sound box 6 and assist in securing guitar cover 1 to sound box 6. The ends of side sheets 26 and 28 at shoulders 20 and 22 respectively can have reenforcement sheets 32 and 34 sewn thereto as shown in FIG. 2.

Front sheet 24 has a large, generally U-shaped recess 36 therein which is adapted to expose bridge portion 18 to allow use of guitar 2 with guitar cover 1 attached. In addition, front sheet 24 has a plurality of slits 38 therein adapted to allow control knobs 16 to extend therethrough and a slit 40 adapted to allow control knob 14 to extend therethrough when the guitar cover 1 is in place on guitar 2. The longitudinal axis of each slit 38 is at about a 30 degree angle with respect to the longitudinal axis of guitar cover 1 to facilitate the installation and removal of guitar cover 1 over control knobs 16. By the term "longitudinal axis of guitar cover 1" is meant the axis oriented along the line of the longitudinal axis of neck portion 8 when guitar cover 1 is properly attached thereto.

Front sheet 24 also has an elongated slit 42 extending from the closed end of recess 36 and oriented generally along the longitudinal axis of guitar cover 1. The provision of elongated slit 42 additionally facilitates the attachment and removal of guitar cover 1, and a fastening means 44 is attached by threads 48 across the open end of elongated slot 42 proximate to recess 36 to normally maintain the opposing sides of slot 42 adjacent to each other to maintain guitar cover 1 tightly against sound box 6. Preferably fastening means 44 is an elastic band as shown in the drawings although alternative means can be used such as a Velcro® fastening means.

Front sheet 24, side sheets 26 and 28, and back sheet 30 of guitar cover 1 are all made of a washable, soft, absorbant material which protects the wood finish from scratches or other marring during normal use. Preferably, cloth material made from a natural soft fiber is used, most preferrably cotton terrycloth. The free edges of front sheet 24 and side sheets 26 and 28 can be turned under and stitched as at 46.

It will be appreciated that while a specific form of this invention has been described and illustrated herein, it is to be understood that the invention may be varied within the scope of the appended claims without departing from the spirit of the invention.

What is claimed is:

1. A slip-on cover for protecting the sound box of an electric guitar having a neck, a bridge portion and a plurality of control buttons, said cover comprising: a front sheet, a side sheet and a back sheet, each comprising a soft absorbant cloth material and each of said front, side and back sheets being sewn together at adjacent perimeter edge portions; said front sheet having a generally U-shaped recess therein adapted to align with said bridge portion, said front sheet further having an elongated first slit extending from the closed end of said recess, and having fastening means for connecting opposing sides of said slit proximate to said recess, and wherein said front sheet has a plurality of second slits therein adapted to receive said control buttons, the longitudinal axis of said second slits being aligned at about a 30 degree angle from the longitudinal axis of said guitar cover.

2. A slip-on cover as recited in claim 1 wherein said front sheet, back sheet and side sheet are made of absorbant cottom material.

3. A slip-on cover as recited in claim 2 wherein said cotton material is terrycloth.

4. A slip-on cover as recited in claim 2 wherein said side sheet comprises two side sheet portions with end portions sewn together.

5. A slip-on cover as recited in claim 4 wherein the free perimeter edges of said front sheet are reversely folded and sewn.

6. A slip-on cover as recited in claim 5 wherein the end portions of said side sheet have reenforcement sheets sewn on the inwardly facing side thereof.

7. A slip-on cover as recited in claim 6 wherein said front sheet, back sheet, side sheet and reenforcement sheets are all made of the same absorbant cotton material.

* * * * *